US005209470A

United States Patent [19]

Cimaroli et al.

[11] Patent Number: 5,209,470

[45] Date of Patent: May 11, 1993

[54] GOLF GREEN SLOPE READING METHOD

[76] Inventors: Sam E. Cimaroli; Harriett L. Cimaroli, both of 170 Mariner La. Rotunda West, Placida, Fla. 33947

[21] Appl. No.: 916,650

[22] Filed: Jul. 20, 1992

[51] Int. Cl.[5] ..... A63B 69/36; A63B 53/04; A63B 57/00

[52] U.S. Cl. ..... 273/32 H; 273/162 B; 273/164.1; 33/379

[58] Field of Search ..... 273/32 H, 162 B, 164.1, 273/187.4, 186.2, 187.6; 33/379, 508, 370

[56] References Cited

U.S. PATENT DOCUMENTS

| | | | |
|---|---|---|---|
| 2,976,046 | 3/1961 | McCullough | 273/162 B |
| 2,995,375 | 8/1961 | Bukovey | 273/162 B |
| 3,632,112 | 1/1972 | Jacobs | 273/162 E |
| 3,826,495 | 7/1974 | Elkins | 273/32 H |
| 4,082,286 | 4/1978 | LaBreche | 273/162 B |
| 4,248,430 | 2/1981 | Kepler | 273/162 E X |
| 4,795,157 | 1/1989 | Bencriscutto | 273/164.1 |
| 4,962,931 | 10/1990 | Jazdzyk | 273/187.4 X |
| 4,984,791 | 1/1991 | Labell | 273/32 H |
| 5,160,142 | 11/1992 | Marshall | 273/162 B X |

*Primary Examiner*—George J. Marlo

*Attorney, Agent, or Firm*—Joseph C. Mason, Jr.; Ronald E. Smith

[57] ABSTRACT

A spirit level is added to the clubhead of a golf club and observation of the bubble in the spirit level tells the golfer the slope of the green when the clubhead is positioned in bridging relation to a golf hole. A pair of indicia members are marked on the top wall of the clubhead on opposite ends of the clubhead so that the spirit level is between them and so that the bubble is exactly midway between them when the green is level. The indicia members are positioned directly above the peripheral edges of the hole when the golfer desires to read the slope of the green. In a preferred embodiment, the indicia members are arcuate to match the contour of the hole to facilitate their alignment with the hole. An opaque cover member is placed over the spirit level during regulation play. It is slideably mounted so that it may be retracted to expose the spirit level during practice sessions.

5 Claims, 3 Drawing Sheets

GOLF GREEN SLOPE READING METHOD

BACKGROUND OF THE INVENTION

1. Field of the Invention

This invention relates, generally, to devices having utility in the game of golf. More particularly, it relates to a device in the form of a putter that enables a golfer to read the slope of a green.

2. Description of the Prior Art

Whether or not a golfer makes or beats par on a hole usually depends on how well the golfer putts. Many players can reach the green in as many swings as a professional player, but few can consistently make the critical putt or putts needed to score eagles, birdies, or to make par.

One of the major obstacles to making putts is the slope of the green; a slope that is barely noticeable can change an easy putt into a difficult putt. Many golfers even have difficulty in determining whether or not a particular green is sloped, and if so, in which direction, especially where the slope is not steep.

Most players circle the hole, kneeling down at differing locations thereabout, in an attempt to better understand the slope of the green; this ritual slows the game down. Just as importantly, the ritual is performed because no one knows a better way to read the slope of the green. Even more importantly, this well-known technique is substantially ineffective; missed putts resulting from improper reading of the slope of the green are commonplace, regardless of how much time and effort the golfer put into circling the hole and looking at the slope of the green from many different vantage points.

A number of inventors have designed putting aids that teach a golfer how to hold the putter, how to swing it, and so on. Moreover, inventors have designed putter heads of many differing varieties in an attempt to make putting more accurate. However, a device that simply measures the slope of the green and provides a visual report to the golfer as to said slope is not found in the prior art.

It follows that the prior art, when considered as a whole as required by law, neither taught not suggested to those of ordinary skill in the field of this invention, at the time the present invention was made, how a device that could perform such direct measurement and which could provide such visual report should be constructed.

SUMMARY OF THE INVENTION

The longstanding but heretofore unfulfilled need for a golf green slope reading device is now provided in the form of a putter having a clubhead of unique design. The novel clubhead includes a pair of indicia members of arcuate clubhead. The indicia members are spaced four and one-quarter inches apart, and have the same curvature as the perimeter of a golf hole. A spirit level is built into the clubhead and is specifically positioned so that the center of the bubble therein is equidistant from the bight of each indicia when the clubhead is perfectly level. The clubhead has a length greater than four and one-quarter inches so that it spans a golf hole when placed thereatop.

To read the slope of a green, the golfer positions the sole of the clubhead in bridging relation to the hole, with the sole of said clubhead resting atop the hole. The clubhead is oriented along any diameter of the hole, and the arcuate indicia members formed in the top wall of the putter are placed into precise vertical alignment with the peripheral border of the hole. Thus, an individual looking straight down at the hole sees it bisected by the clubhead, and the arcuate indicia means on the top wall of said clubhead is coincident with diametrically opposed arcs of the circle formed by the hole. If the hole is perfectly level, the bubble in the spirit level will be precisely centered, i.e., it will be equidistant from the mid-point of each arcuate indicia means. If the hole is not perfectly level, the bubble will be off center in a direction that informs the golfer as to which way the green is sloped. By observing the offset distance between the bubble and its central position, the golfer can determine, qualitatively, the amount of the slope. Armed with this information, the golfer can then make a putt along a line that compensates for the slope of the green. The time-consuming and unreliable prior art green-reading technique, discussed earlier, is therefore eliminated.

An opaque closure means for covering the spirit level is also provided so that the novel putter may be used in regular play as well as in practice sessions. The closure means may be hingedly secured to the clubhead, snap fittingly engaged thereto, or mounted thereto in any other suitable manner.

It is therefore understood that the primary object of the present invention is to provide a golf green slope reading device that enables a golfer to improve his or her putting game.

Another important object is to accomplish the foregoing object in the form of a putter that may be used during play.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
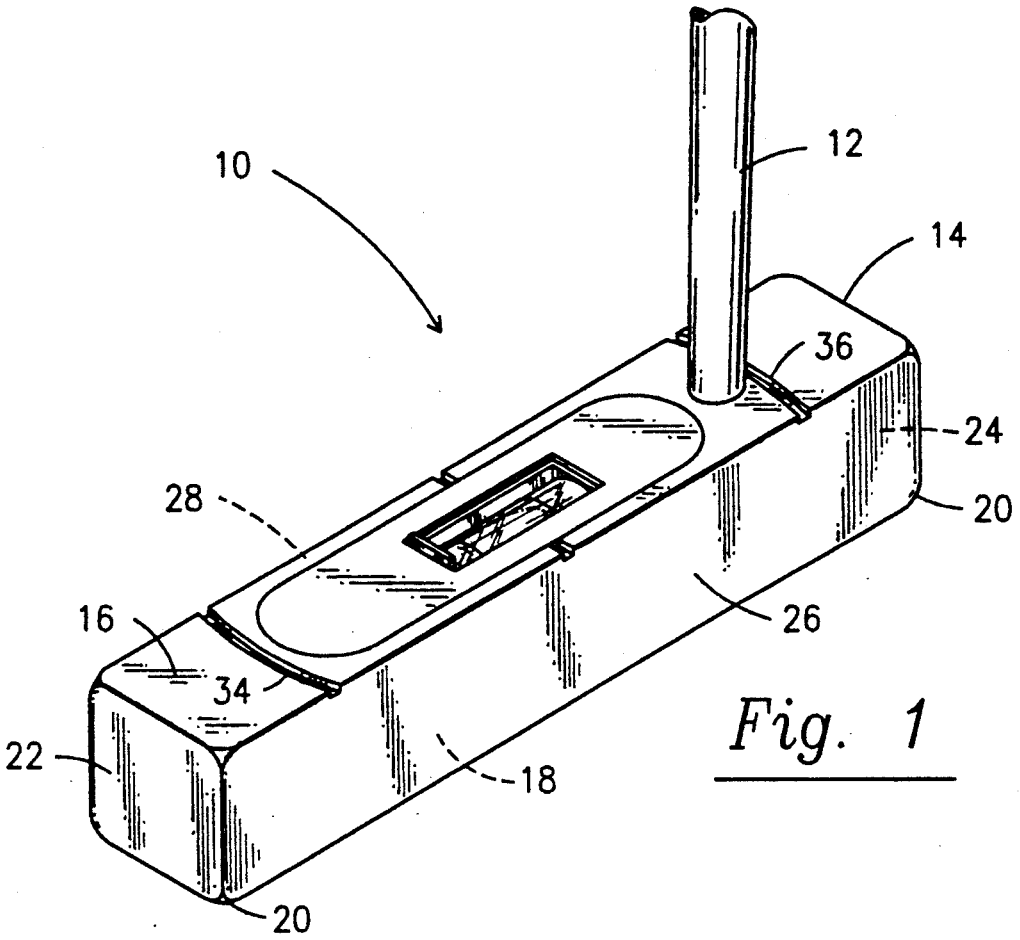
FIG. 1 is a perspective view of the novel putter.
Figure 2:
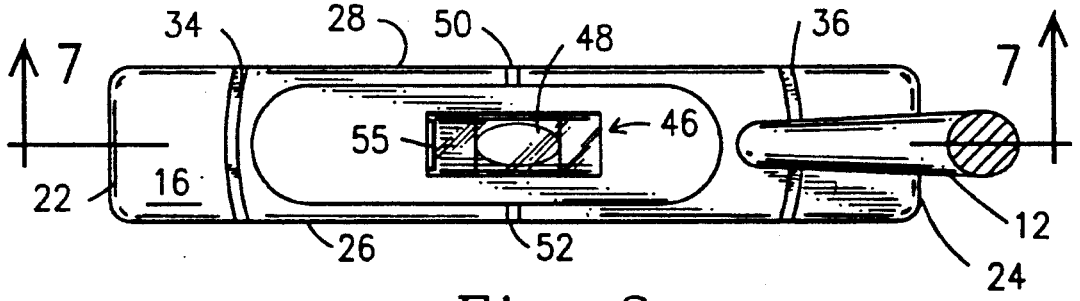
FIG. 2 is a top plan view thereof, showing a closure means in its retracted position.
Figure 3:
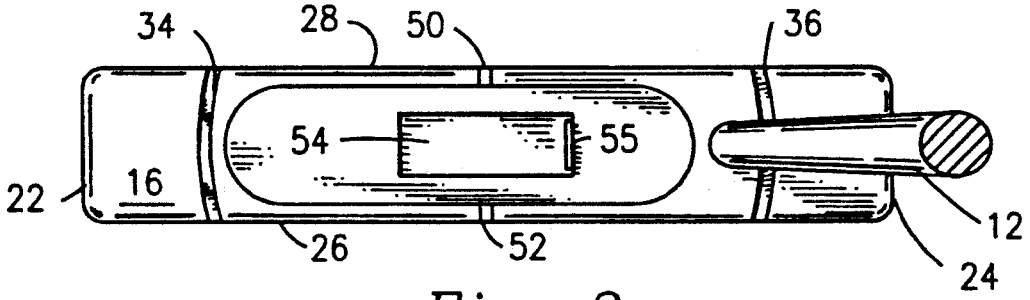
FIG. 3 is a top plan view thereof, showing the closure means in its extended position.

Referring now to FIGS. 1–3, it will there be seen that the novel putter of this invention is denoted as a whole by the reference numeral 10. As will become clear as this description proceeds, the novel club Will determine the position of the cup, thereby defining the break of a green, or absence thereof, i.e., from right to left, left to right, or straight in.

Shaft 12 of putter 10 has no hosel but is otherwise conventional; the clubhead 14 is not conventional. Said clubhead 14 includes flat top wall 16, a flat sole 18 having rounded corners 20, toe wall 22, heel wall 24, and parallel side walls 26, 28. Significantly, the clubhead has zero degrees of loft. This eliminates skidding of the ball in the putting stroke, thereby providing a truer line to the intended target. Note in FIG. 2 that the clubhead 14 exhibits bilateral symmetry about its longitudinal axis. Thus, it is usable by left-handed and right-handed golfers alike. Moreover, due to the zero degree loft, the novel clubhead does not have just one sweet spot, i.e., the ball can be struck with any part of the club. For example, even if the ball is hit with the toe of the clubhead, it will go true on line. Thus, if a ball lies close to a wall or other obstacle, it is not necessary to take a drop and a one stroke penalty because any part of the clubhead may be used to hit the ball, and the club may be swung left or right-handed as conditions dictate. The novel club, therefore, may be used as a utility club.

The longitudinal extent of clubhead 14 is greater than the longitudinal extent of conventional clubheads. Its length is selected so that when the clubhead is placed in bridging relation to a golf hole, it will not enter thereinto.

Figure 4:
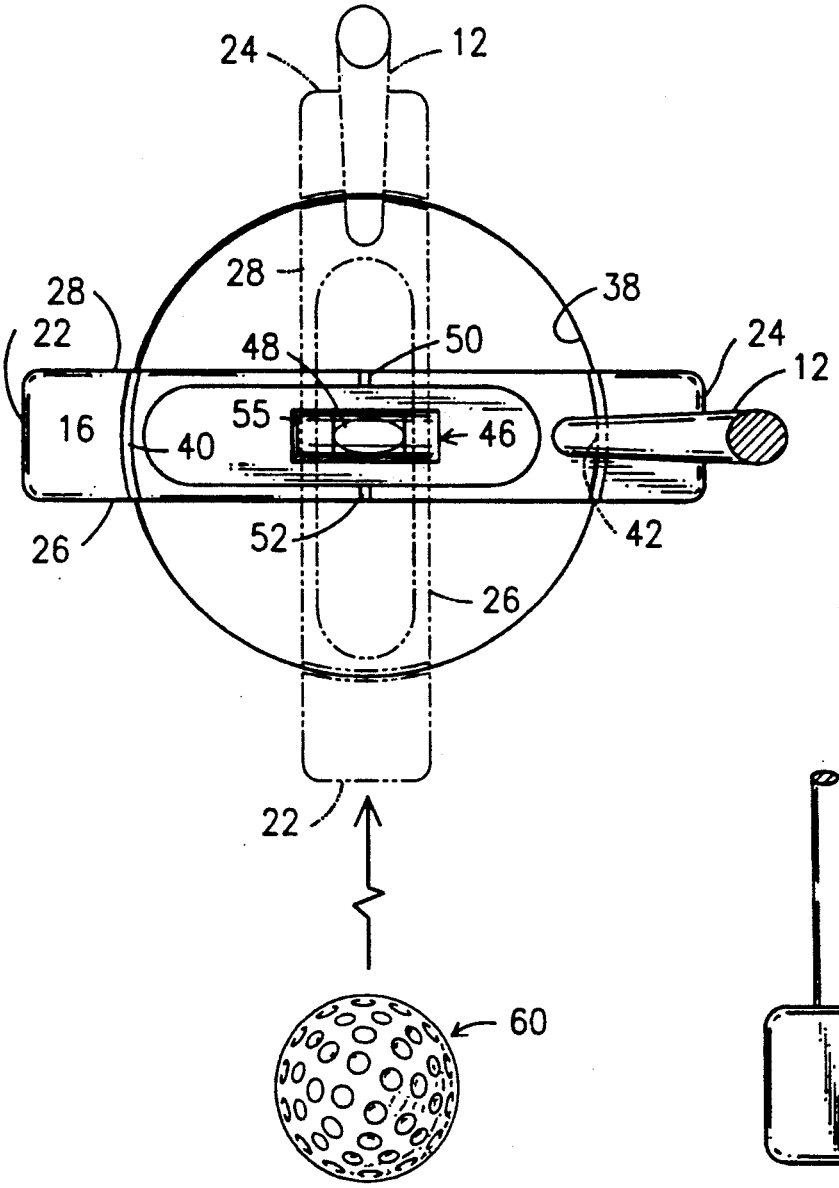
FIG. 4 is a plan view of a golf cup, showing how the novel putter is used to read the slope of the green within which said cup is formed.
Figure 5:
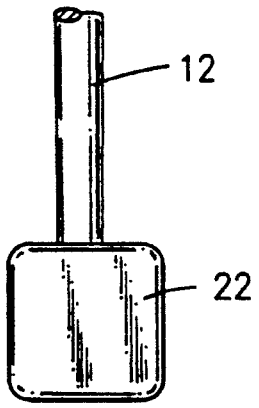
FIG. 5 is a front end view of the novel putter.
Figure 6:
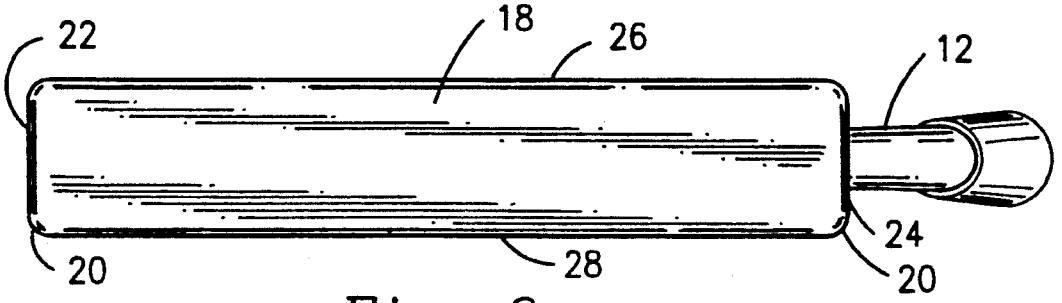
FIG. 6 is a bottom plan view thereof.

Arcuate indicia members 34, 36 are formed in or otherwise applied to top wall 16. FIG. 4 shows how said indicia members align with the perimeter of a golf hole 38 when the clubhead is placed thereacross in coincidence with a diameter thereof. Each indicia member has a curvature equal to the radius of the golf hole. Thus, the respective bights or mid-points 40, 42 of the indicia members are precisely four and one-quarter inches apart because that is the diameter of a regulation golf cup.

A second pair of indicia members, denoted 50, 52, is positioned midway between arcuate indicia members 34, 36. Bubble 48, when centered as depicted in FIG. 4, is bisected by an imaginary line extending between the indicia members of said second pair of indicia members 50, 52. Thus, the presence of said second pair of indicia members helps the golfer read the spirit level and to line up the ball, as will be more fully set forth hereinafter. Importantly, when the green is slightly sloped, the second pair of indicia members make it easy for the golfer to detect the slight off center position of the bubble.

Figure 8:
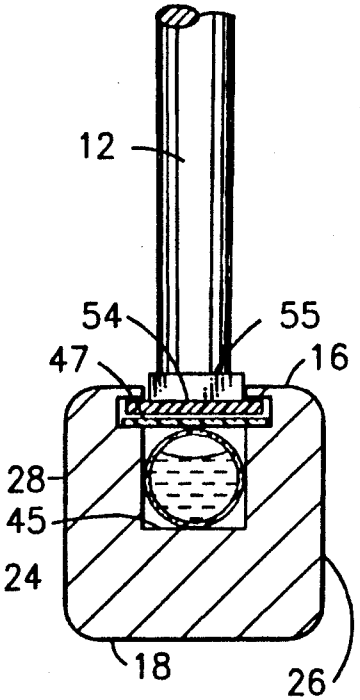
FIG. 8 is a sectional view taken along line 8—8 in FIG. 7.
Figure 7:
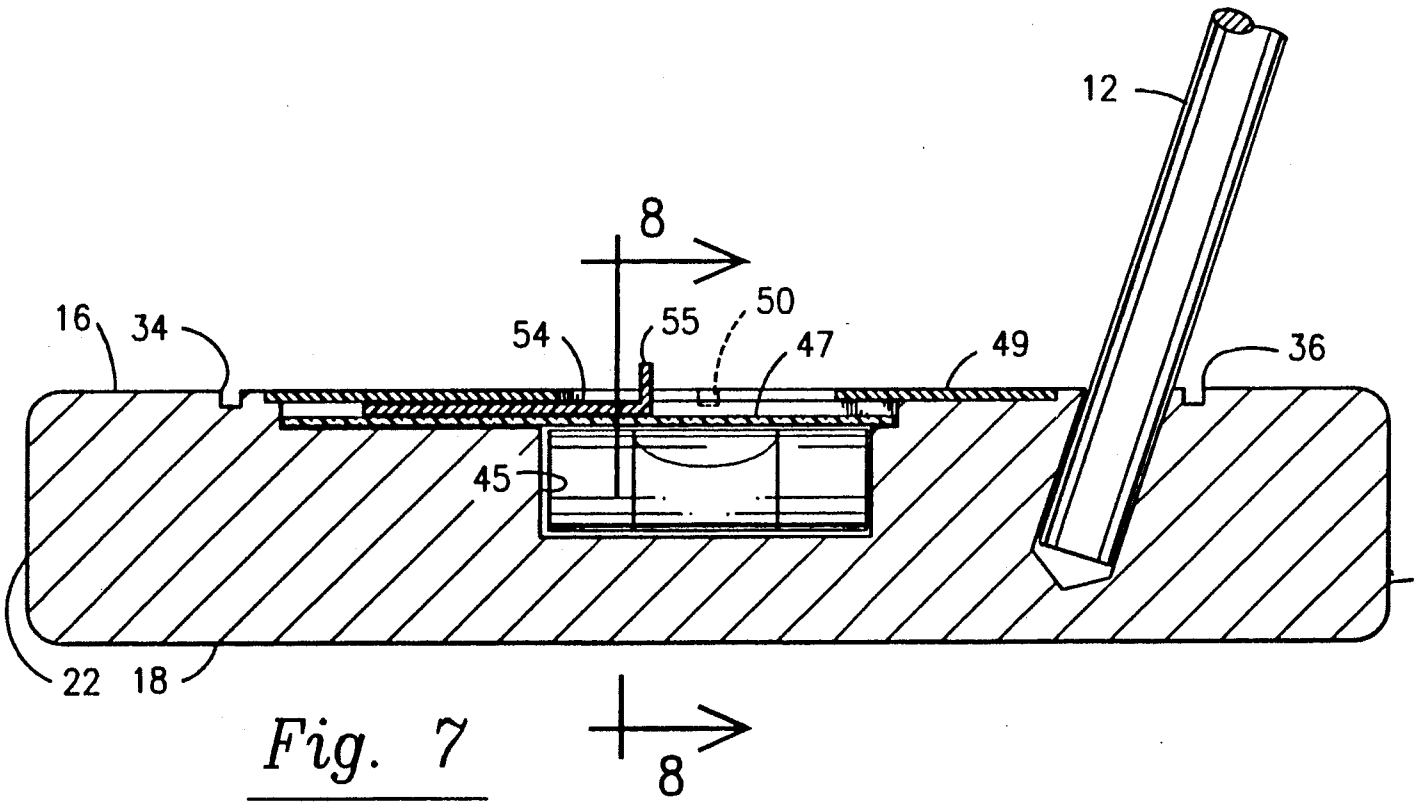
FIG. 7 is a sectional view taken along line 7—7 in FIG. 2.

Spirit level 46 is positioned within a recess 45 formed in the clubhead, as best shown in FIGS. 7 and 8. It is maintained in said recess by a transparent flat plate or retention means 47.

A slideably mounted opaque cover member 54 having an upstanding handle means 55, both of which are made of a suitable high impact plastic, is sandwiched between said transparent retention means 47 and a frame member 49 that is mounted flush with top wall 16 of the clubhead 14. Thus, opaque cover member 54 is extended into covering relation to spirit level 46 by grasping handle 55 and sliding it from left to right in FIG. 7; it is retracted to expose said spirit level by sliding said handle 55 from right to left.

Closure means 54 is depicted in its fully retracted position where the spirit level is uncovered in FIGS. 1, 2, and 4, and is shown in its fully extended position where it covers the spirit level in FIG. 3; FIG. 7 shows an intermediate position. The rules of golf do not permit use of attachments such as visible spirit levels during tournaments or other regulation play; accordingly, closure means 54 is closed as shown in FIG. 3 so that the golfer cannot see it when the putter is being used in an event where the rules are applicable. This feature provides versatility and thus avoids the need for the golfer to purchase a separate club for play.

When cover 54 is closed, sight lines 50,52 may be used to line up the ball for the intended stroke along the line as determined when reading the slope. It should be noted that after the break has been read, the cover is closed before making the putt.

FIG. 4 shows the position of bubble 48 when the clubhead is bridging a hole in a perfectly level green. Where the green is sloped, it is a simple matter to observe the position of the bubble and to determine the direction of the slope. The amount of slope can also be determined, at least on a qualitative basis. Since the novel clubhead complies with the aforesaid rules, it is precision designed to meet the requirements of professional golfers. It is intended for use as a teaching aid, a practice aid, and it may also be used in the course of play.

To use the novel putter, the golfer will normally make two readings as indicated in FIG. 4. The first reading is taken with the longitudinal axis of the clubhead coincident with an imaginary line from the ball 60 to the cup, as indicated in phantom lines in said FIG. 4, and a second reading will be taken at ninety degrees thereto, as indicated in solid lines in said Figure.

The novel putter, to be sold under the trademark "The Mulligan Putt Saver," is a powerful and effective training tool. When used in practice, with cover 54 open, it forces the golfer into the correct stance, i.e., with head and eyes over the ball for maximum alignment of a pendulum stroke. This position keeps the body and head motionless, creating a better upper radius. With practice, the golfer's muscle memory will transfer the mechanics of the stroke from the practice green to the course in regular play. The golfer's body will respond and remember the correct stroke.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method for reading the slope of a green in the game of golf, comprising the steps of:

using a clubhead having a longitudinal extent greater than the diameter of a golf hole in a putting green to be played;

marking a top surface of said clubhead with a pair of indicia members that are spaced apart from one another by a distance equal to the diameter of said golf hole;

positioning a spirit level having a bubble therein on said clubhead so that the bubble is centered in said spirit level when it is exactly midway between said indicia members; and positioning said clubhead in diametrically bridging relation to said golf hole so that said indicia members are in vertical alignment with the peripheral boundary of said golf hole, said positioning causing said spirit level to provide information concerning the slope of the green encircling said hole.

2. The method of claim 1, further comprising the step of flattening the sole of said clubhead to facilitate its placement in bridging relation to said golf hole.

3. The method of claim 2, further comprising the step of marking said top surface of said clubhead with a second pair of indicia members and positioning each member of said second pair of indicia members substantially exactly midway between said first pair of indicia members.

4. The method of claim 3, further comprising the step of configuring each indicia member of said first pair of indicia members to have an arcuate configuration having a curvature equal to the curvature of a golf hole.

5. The method of claim 4, further comprising the step of covering the spirit level with an opaque closure means when the clubhead is used in a game of golf.

* * * * *